United States Patent [19]

Saun

[11] 4,003,165

[45] Jan. 18, 1977

[54] MACHINE FOR BEVELING LENSES

[75] Inventor: Antonio Angaron Saun, Hospitalet De Llobnegat, Spain

[73] Assignee: Proptic, S.A., Barcelona, Spain

[22] Filed: July 8, 1975

[21] Appl. No.: 594,038

Related U.S. Application Data

[63] Continuation-in-part of Ser. No. 520,142, Nov. 1, 1974, abandoned.

[30] Foreign Application Priority Data

Nov. 2, 1973 Spain ..... 420190

[52] U.S. Cl. ..... 51/101 LG

[51] Int. Cl.[2] ..... B24B 13/04

[58] Field of Search ..... 51/101 R, 101 LG, 284 E

[56] References Cited

UNITED STATES PATENTS

| | | | |
|---|---|---|---|
| 3,745,720 | 7/1973 | Savage | 51/101 LG |
| 3,798,844 | 3/1974 | Hannaman | 51/101 LG |

*Primary Examiner*—Harold D. Whitehead
*Assistant Examiner*—Nicholas P. Godici

[57] ABSTRACT

A machine for bevelling lenses having a fixed base and a moving carriage is provided with tracing means which follows the profile of a template corresponding to the lens to be bevelled. A reducing grinding wheel and a bevelling wheel are driven by respective motors and housed in the fixed base. The lens to be bevelled is mounted on the moving carriage, guided by the tracing means, which are programmed by means of control elements, so that automatic operation of the machine is obtained.

6 Claims, 6 Drawing Figures

MACHINE FOR BEVELING LENSES

This is a continuation-in-part of application Ser. No. 520,142 filed Nov. 1, 1974, now abandoned.

BACKGROUND OF THE INVENTION

1. Field of the Invention

The present invention refers to improvements in machines for bevelling lenses, of the type comprising a fixed base and a hinged moving carriage with movement of the carriage towards the diverse working areas of a plurality of grinding wheels for reducing and bevelling the lenses, with self centering of the latter and comprising a tracing follower engaged by a spring loaded template, allowing for automatic operation from the time the lens is positioned, with capability of admitting any type, shape or grade of lens, apart from providing a more rational reducing and bevelling action than the machines used up to date. It also allows unskilled labour to be used.

2. Summary of the Invention

The above improvements are characterised in that the upper moving carriage carrying the actuating mechanisms is driven according to a tracing means which follows the profile of a template corresponding to the lens to be bevelled. The bevelling is effected through the successive action of the reducing wheel which provides the lens with a suitable peripheral design and by the bevelling wheel which provides the lens with the appropriate bevel. These grinding wheels are driven by respective motors and are housed in a lower fixed base of the machine. The lens to be bevelled is mounted on a shaft having a locking means for axial holding of the lens and which is driven through transmission means from an intermediate shaft associated in turn with a drive shaft, said intermediate shaft also driving a shaft carrying a double cam controlling the lateral movements and angular elevation of said moving carriage, through respective mechanisms, said carriage being guided by the tracing means which may be programmed according to different types and magnitudes of lenses by way of control elements which are adjusted in accordance with tables established for the diverse variables of the lenses.

The lens reducing process is effected when required by a quick action means, to shorten the process time, which in the areas where the lens is to be ground away to a greater depth, produces a forward and reverse reciprocating rotational movement of the lens relative to the reducing wheel.

The regulation of the difference of material to be removed from the lens between the reducing and the bevelling wheels is effected by a means which adjusts in each case the time the lens passes from one wheel to the other.

BRIEF DESCRIPTION OF THE DRAWINGS

Other objects and features of the invention will be disclosed in detail in the following description, reference being had to the annexed drawing in which.

DETAILED DESCRIPTION OF THE INVENTION

The machine according to the invention comprises essentially a fixed lower base 1 and a moving upper carriage 2.

Figure 3:
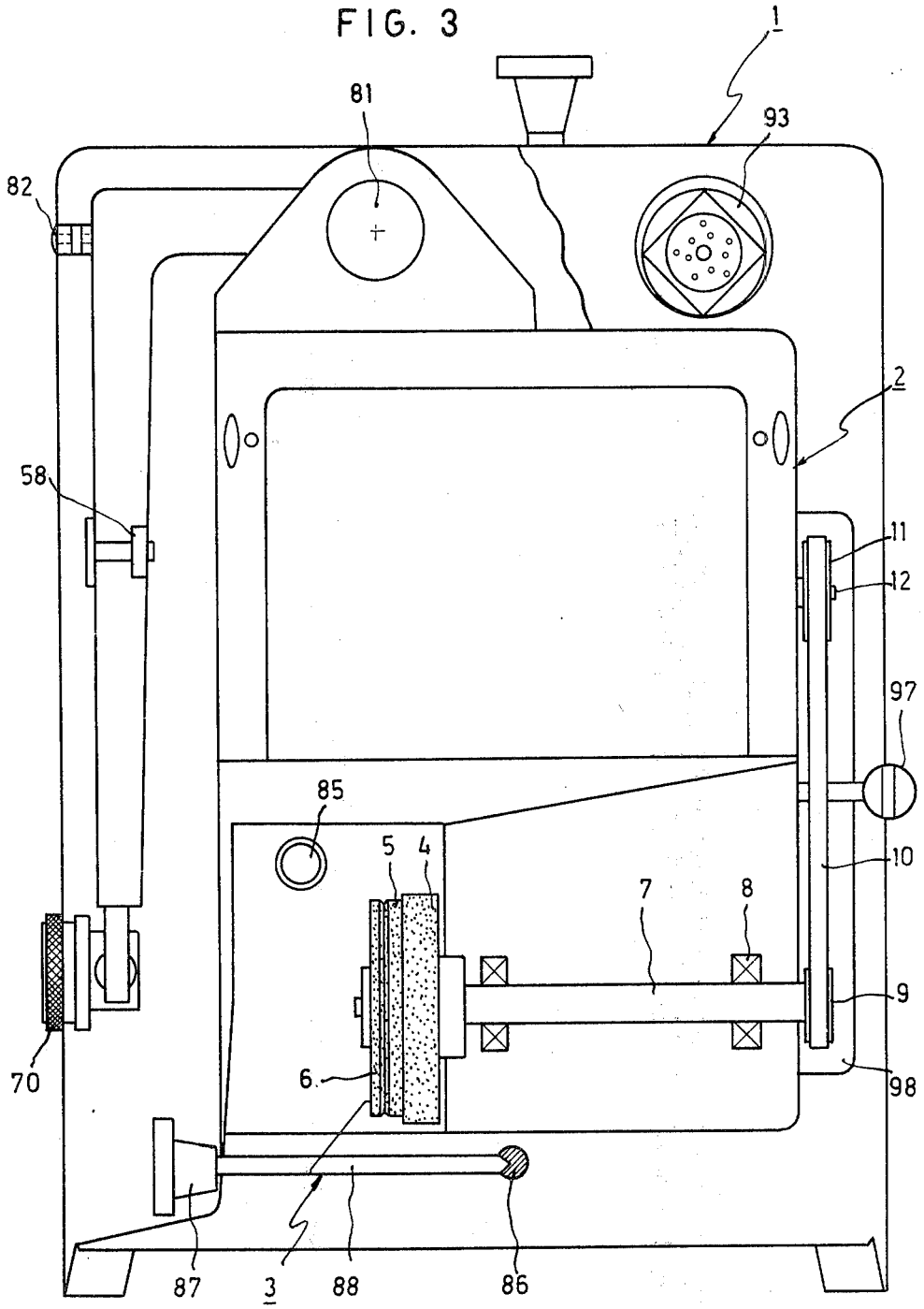
FIG. 3 is a plan view from above of the machine fixed base.

The fixed base 1 (FIGS. 3 and 5) houses a grinding wheel set 3, comprising a reducing wheel 4 and a bevelling wheel 5 having a peripheral groove 6 mounted on a shaft 7 running in bearings 8. Said shaft 7 carries a pulley 9 for a belt 10 trained around a further pulley 11 mounted on a shaft 12 of a drive motor 13. Said motor 13 is associated with a tension mechanism 14 with spring 15 and adjusting knob 16, said motor rocking in a support 17 pivoted on a shaft 18, whereby the belt 10 is kept suitably tensioned.

The moving carriage 2 houses a mechanism comprising an electric motor 20 having a shaft 21 attached to a pulley 22 associated with a further pulley 24 through a belt 23, said pulley 24 being attached to an intermediate shaft 25 running in bearings 26. Further pulleys 27 are mounted on said intermediate shaft 25 for driving further pulleys 29 through belts 28. One of said pulleys 29 is attached to a halfshaft 30 and the other to a halfshaft 31 to hold the lens to be bevelled, mounted respectively in bearings 32 and 33. Halfshaft 31 is axially adjustable by way of a control means 34 and has a support 35 for a locking means; in turn halfshaft 30 has a further support 36 for a locking means, which means are not shown in the drawing. When support 35 of halfshaft 31 is moved towards the support 36 of halfshaft 30 by way of the control 34, the corresponding locking means are suitable for holding the lens to be bevelled in the centre thereof, without damaging the surface and locking the lens so as to cause it to rotate with the halfshafts 30, 31 as required. The outer end of halfshaft 30 is provided with means for holding a template 37, the profile of which mates with the profile required of the lens to be ground. Said template 37 is also locked to rotate with the halfshaft 30 as required.

Figure 1:
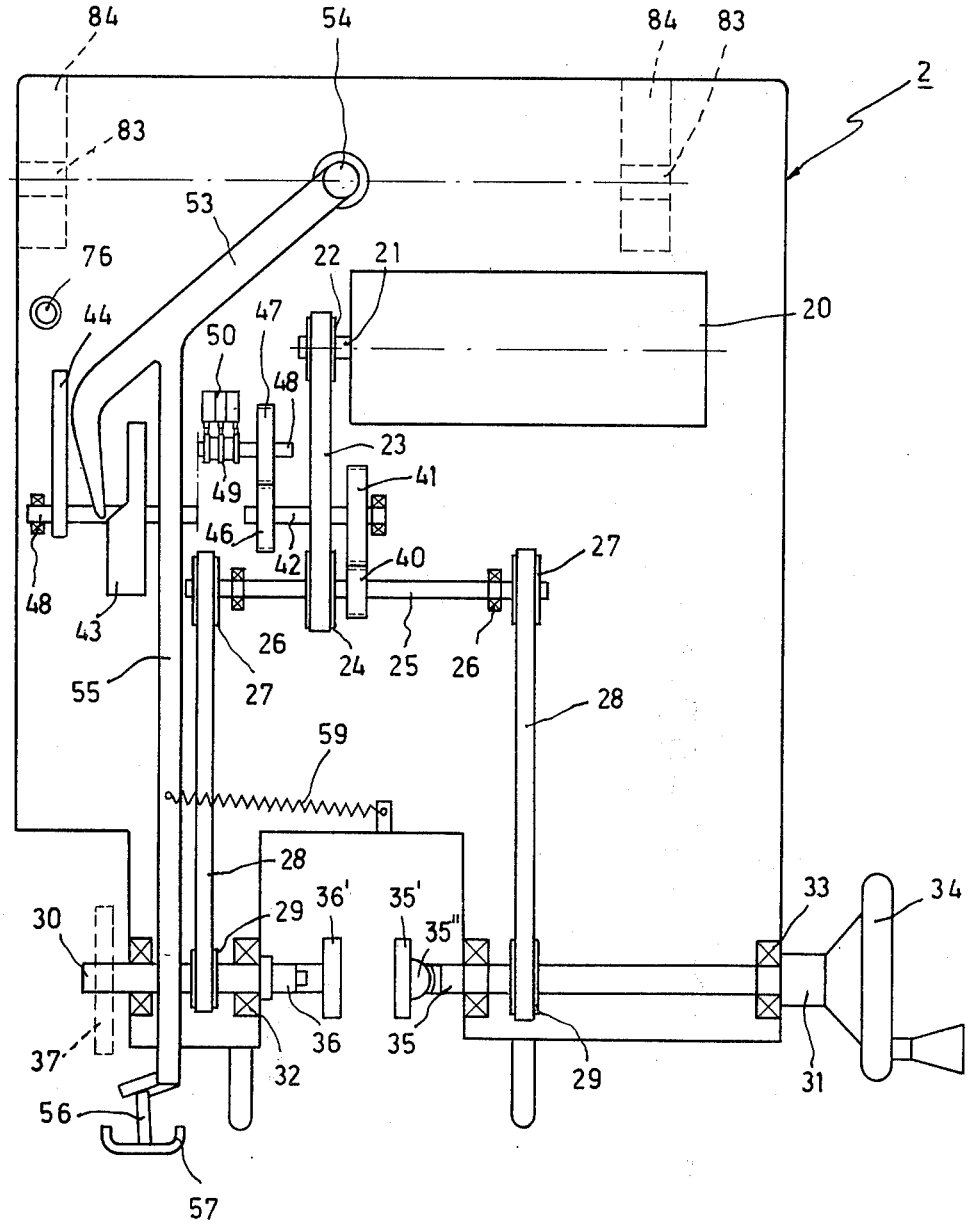
FIG. 1 is a plan view of the moving carriage of the bevelling machine according to the invention, the cover having been removed.

The intermediate shaft 25 transmits its rotation to a shaft 42 by way of gears 40 and 41 and said shaft 42, in turn, transmits its rotation to a shaft 48 by way of gears 46 and 47 (for clarity, shaft 48 is shown split in FIG. 1), said shaft 48 being fitted with cams 43 and 44 and a drum 49 for actuating microswitches 50.

Figure 2:
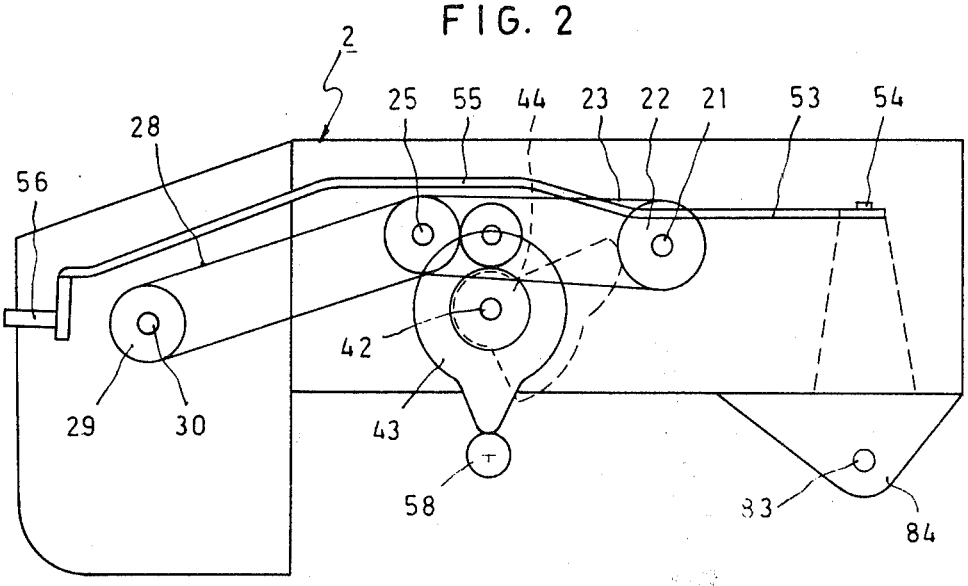
FIG. 2 is a side elevation view of said carriage, the protective cover having been removed.
Figure 4:
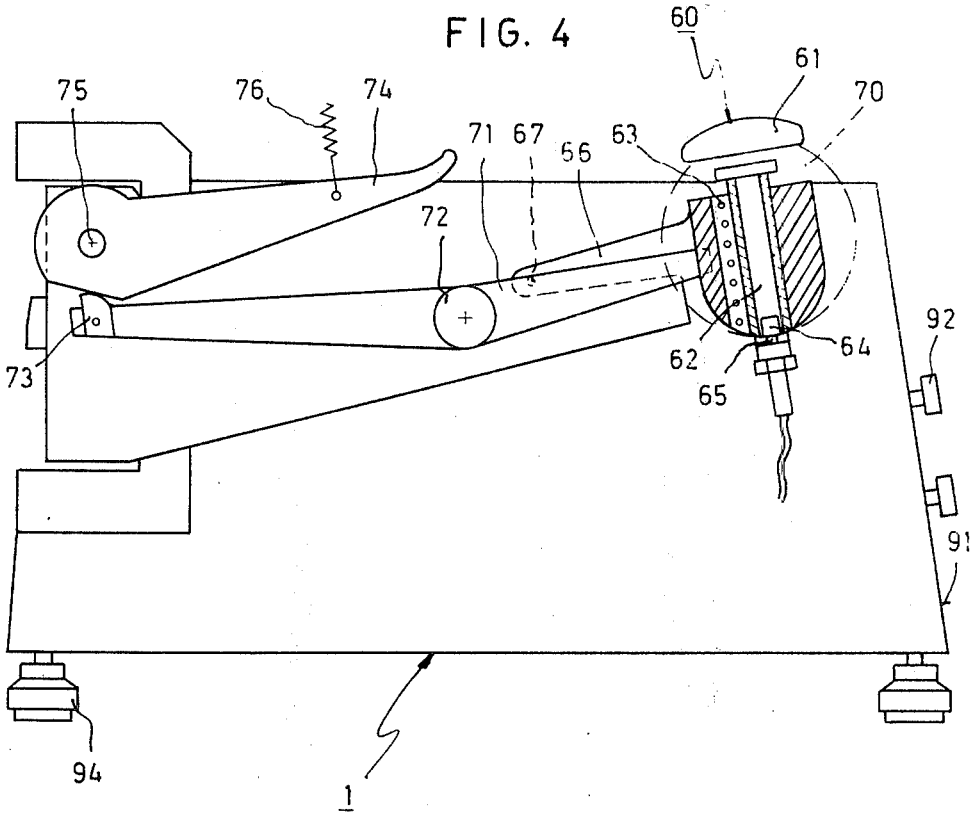
FIG. 4 is a side elevation view of said fixed base.

Cam 43 is double acting. Its periphery (FIG. 2) is applied against a roller 58 of the fixed base 1 and produces the angular elevation of the carriage 2 at its cycle start or end position. The cupped portion of cam 43 (FIG. 1) produces the transverse movement of the carriage 2 for changing the grinding wheel, as will be explained hereinafter. Only the periphery of cam 44 is operative and its action on lever 74, as explained hereinafter causes the necessary elevation of the fixed carriage 2 to allow for the said transverse movement for the wheel changeover.

Carriage 2 (FIGS. 1 and 2) houses an arm 53 adapted for rotation relative to the carriage 2 around a point 54 at the rear end thereof. Arm 53 is attached to a lever 55 carrying a feeler 56 applied against a guide 57 which is attached to the base 1 by means not shown in the drawing. Said guide (shown with exaggerated tolerance in FIG. 1) holds the feeler 56 in its groove and thereby holds lever 55 and arm 53, preventing the free rotation thereof around point 54.

Arm 53 bears constantly against cam 43 (cup portion) under the effect of a spring 59, attached at one end thereof to lever 55 and at the other to the moving carriage 2. Arm 53, as mentioned above, may not rotate freely around point 54 since the feeler 56 at the front end thereof is held in the groove of guide 57. Thus while arm 53 is applied to the wide portion of the cam cup 43, the moving carriage 2 is held moved towards the righthand side, placing the lens to be bevelled under the effect of the reducing wheel 4 and when arm 53 is applied to the narrow portion of cam cup 43, the moving carriage is moved to the lefthand side of FIG. 1 and places the lens to be bevelled in position for being worked by the bevelling wheel 5.

A feeler means 60 comprises a sector 61 adapted for engagement with template 37. Sector 61 is mounted on a longitudinally movable shaft 62 and is urged by a spring 63. Shaft 62 has a contact 64 opposed to a further fixed contact 65 attached to the electrical circuit and only when both contacts touch as a result of movement of shaft 62 is the motor 20 driven. Feeler means 60 is attached to a pendulum 66 pivoting around point 67.

An adjusting drum 70 is adapted, by known means not shown in the drawing, to move sector 61 according to the direction of shaft 62. This effect may be obtained with a cam having an Archimedean screw profile driving shaft 62. With this movement of the sector 61, the grinding size of the lens may be increased or reduced with respect to the size of the corresponding template, as will be understood from an explanation of the machine operation.

The feeler means 60 is adapted to receive the action of a rocker arm 71 pivoting around a shaft 72 and having a rear butt 73 bearing against a lever 74 adapted to pivot on a shaft 75. An extension spring 76 tends to raise lever 74 and hold it bearing against cam 44.

A drum 80 has two drums 80A and 80B which are adapted, by conventional means not shown in the drawing, to cause respectively a variation of the angle of slope of the guide 57 and limited horizontal transverse translation thereof. Said slope and translation are preset according to a program based on tables calculated according to the variations of lens to be bevelled, such as: lens diameter, the thickness thereof and radius of curvature of the convex face.

These possible changes of position of the guide 57 means for each point of the angular elevation of the moving carriage 2 and, therefore, of the corresponding angular elevation of the arm 53 a different point of support for the feeler 56 in the guide 57 which, in view of the above mentioned blocking of arm 53 by point 54 and by guide 57 causes transverse movement of the carriage 2 through the action of the end of arm 53 on cam 43, causing the lens to be bevelled to position itself suitably with respect to the bevelling wheel 5, so that the bevelling is centered in each point around the periphery of the lens.

The base 1 is attached to the carriage 2 about a pivoting point 81 (FIG. 3) which allows the carriage and the lens to be moved to the diverse operative areas of the grinding wheels 3, allowing for self centering of the lens in the grooves of the grinding wheels as the lens itself turns. Hinges 82 of the carriage 2 are attached to the arm of the carriage through a bore 83 in lugs 84.

While being bevelled, the lens are cooled by a liquid jetted for that purpose and removed through a drain 85. To afford protection from splashing there is a screen supported by a rod 86 associated with a locking means comprising an external knob 87 and a shaft 88 inserted in a notch 89 of rod 86.

Figure 5:
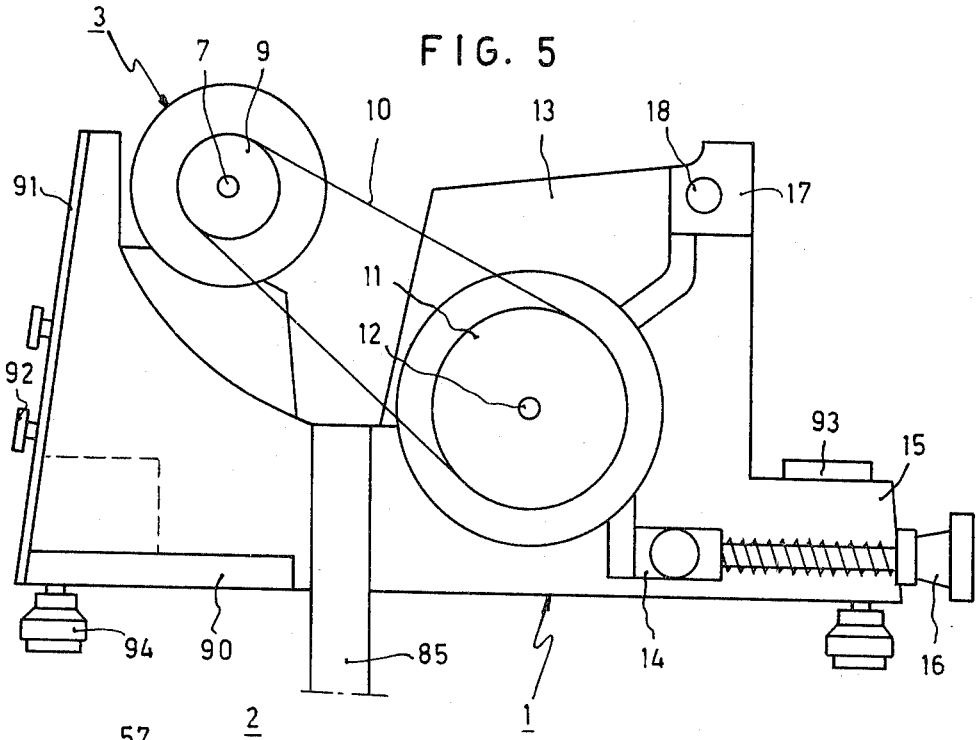
FIg. 5 is a side elevation view of the interior of said fixed base.
Figure 6:
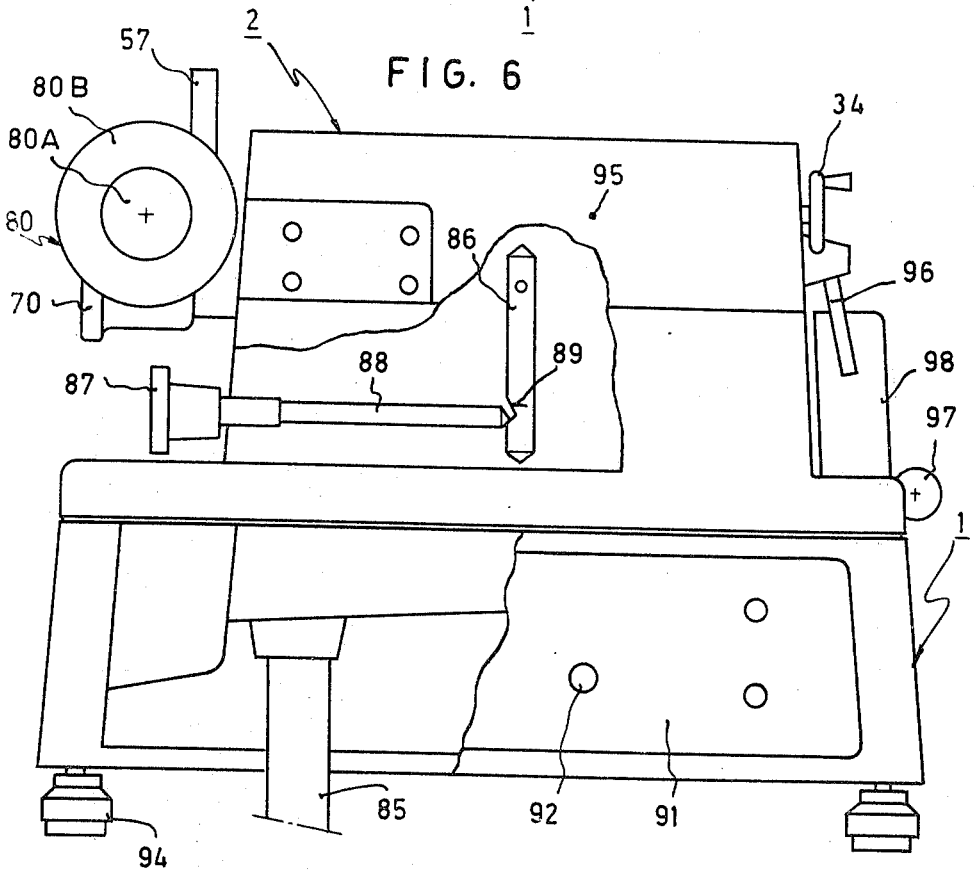
FIG. 6 is a front elevation view of the machine of the invention without the electrical equipment panel.

The electrical equipment, FIGS. 5 and 6, is mounted on a tray 90 attached to a front panel 91, and is mounted as a separable package unit. Said panel 91 contains control, protection and monitoring members 92.

The wiring for said electrical equipment is housed in a protective sheath and is attached to a multiple base 93.

The base 1 rests on screws 94 for adjusting the level. The carriage 2 is provided with a cover 95 which may be removed by actuating a lever 96 at the side. A further lever 97 provides for removal of a side cover 98 covering the belt 10.

The machine operates as follows: the locking means (not shown in the drawing) are mounted in supports 35 and 36 of halfshafts 31 and 30. Halfshaft 31 is moved by way of control 34 until the lens to be bevelled is held firm. The template is also inserted in the outer end of halfshaft 30.

According to the known data such as the diameter of the lens to be bevelled, the thickness thereof and the radius of curvature of the convex surface and following a reading taken from a table calculated according to these variables and relating them to the drum adjustment, the corresponding slope and transverse horizontal translation of guide 57 are set by way of drums 80A and 80B. Since the feeler 56 attached to lever 55 of arm 53 is held in the groove of said means 57, the corresponding position of carriage 2 is set.

Any small movement of sector 61 in either direction of shaft 62 is set by way of adjusting drum 70 and this, in due time, will cause the template 37 to engage sector 61 at a set height.

The lens to be bevelled bears against the reducing wheel 4 which determines the angular elevation of the moving carriage 2 over the fixed base 1. The grinding wheel motor 13 and motor 20 for rotating the lens to be bevelled and turning the shaft 48 are switched on, without motor 20 starting running yet, since no contact has been made between contact 64 of shaft 62 and fixed contact 65. The reducing wheel 4 starts to operate on the lens to be bevelled, which lens is cooled by the liquid jetted for this purpose. The progressive grinding of the lens causes a reduction of the angular elevation of the moving carriage 2 until the template 37 engages the sector 61 of feeler means 60. This moves shaft 62 and, thereby, causes contact 64 to engage contact 65, whereby motor 20 operates to cause an angular movement of the lens. The lens then bears against the reducing wheel 4 at a point not previously ground away, causing a corresponding elevation of the moving carriage 2 and, therefore, separation of contacts 64 and 65, whereby the motor 20 stops running. Thus a further point of the lens periphery is reduced, causing the angular elevation of the moving carriage to drop again, the template to engage sector 61 again, a further angular movement of the lengs, the moving carriage to rise again and the motor 20 to stop running again. This process is repeated successively until the whole of the periphery of the lens has been rough ground which, is will be understood, takes place during a single turn of the halfshafts 30 and 31, giving the rough ground lens the same peripheral shape as the template. During this reducing stage, any slope of the guide 57 causing transverse movement of the moving carriage 2 as a result of the variation of its angular elevation, has no further consequence than to move the lens transversally over the reducing wheel 4, but it does not modify the rough grinding effect in any way whatsoever.

The rotation of shaft 25 produces a fraction of a turn of shaft 48 through gears 40 and 41, intermediate shaft 42 and gears 46, 47 and, therewith, movement of cams 44 and 43. At the right time, cam 44 presses lever 74 downwardly around shaft 75, whereby lever 74 presses against butt 73 of rocker arm 71 which pivots about shaft 72 and raises feeler means 60 by way of its pendulum 66 pivoting around point 67, which uplift is transmitted to the template 37 and, therefore, to the moving carriage 2. The consequent raising of the lens to be bevelled with respect to the reducing wheel 4 makes it possible to move the carriage 2 transversely so that the lens may leave the reducing wheel 4 and engage the bevelling wheel 5.

This transverse movement is determined by the cupped portion of cam 43. When the rotation of cam 43 takes the thin part of the cup into engagement with the end of arm 53, the fact that the arm 53 is locked at point 54 and in guide 57 and the force of spring 59 causes a transverse movement of the moving carriage 2 towards the left of FIG. 1, at which time the cam 44 cease to act, whereby the moving carriage 2 descends again and places the lens in contact with the bevelling wheel 5, at which time the bevelling action commences and continues without interruption, with the template 37 in constant engagment with sector 61, until cam 43, with its periphery in engagement with roller 58, causes the moving carriage 2 to rise in its end-of-cycle movement. The special shape of the bevelling wheel 5 allows normal bevels covering the whole of the lens profile or bevels with lateral plane surfaces to be obtained.

The shape of the template 37 produces variations in the angular elevations of the moving carriage, which variations produce transverse movements of said carriage 2 as a result of the slope of the guide 57, as mentioned above. This means that at all times the lens to be bevelled receives the action of the groove 6 in the precise point of its periphery.

The transverse horizontal translation of the guide 57, preset by drum 80a, causes the bevelling to take place along the most appropriate surface line according to its width when a thick lens is being bevelled.

The adjustment provided by drum 70 is adapted to allow a lens similar to the template, although slightly larger or slightly smaller within certain limits, according to whether the segment 61 has been raised or lowered. In this way contact between the sector 61 and template starts sooner or later, providing for a deeper or shallower rough grinding action.

What I claim is:

1. A machine for beveling lenses by accomplishing a rough grinding stage and beveling stage upon said lens comprising:

a fixed base, a reducing wheel rotatably mounted on said fixed base for accomplishing said reducing stage, a beveling wheel rotatably mounted on said fixed base in juxtaposed relation to said reducing wheel for accomplishing said beveling stage, means for driving said reducing wheel and said beveling wheel in rotation, a carriage mounted on said fixed base, said carriage being laterally movable with respect to said base between a rough grinding position and a beveling position, and being vertically movable with respect to said base between an inoperative position wherein said lens is held spaced from said wheels and an operative position, first and second halfshafts mounted coaxially on said carriage for rotation thereon, said halfshafts terminating in first ends in opposed spaced relationship to one another, each of said first ends having lens holding means attached thereto for cooperating together to hold a lens to be beveled, said first halfshaft being adjustably movable axially with respect to said second halfshaft so that a lens can be held clamped between the pair of said lens holding means, said second halfshaft having a template mounted thereon, said halfshafts being so located on said carriage as to hold a lens generally vertically aligned with said grinding wheel and said beveling wheel, motor means operatively connected to said halfshafts for selectively rotating said halfshafts, first carriage moving means for moving said carriage laterally between said rough grinding position and said beveling position comprising a rotatable first cam having first and second side cam surfaces spaced from one another along the direction of lateral movement of said carriage, and spaced radially from one another on said first cam, said first side cam surface being associated with said rough grinding position and said second side cam surface being associated with said beveling position, said first cam being mounted on a first shaft, an arm pivotally mounted on said carriage and extending across said carriage generally perpendicularly to the direction of lateral movement of said carriage, said arm being movable in a plane generally parallel to said carriage and comprising a follower portion engageable with said first and second side cam surfaces and an end portion terminating in a feeler, first resilient means biasing said arm toward said first and second side cam surfaces, an inclinable guide mounted on said fixed base and engaging said feeler, said guide positioning said feeler laterally with respect to said fixed base, whereby rotation of said first cam causes said carriage to move between said rough grinding position and said beveling position, and motor means operatively connected to said first shaft for rotating said first shaft in synchronized relationship with said halfshafts whereby said halfshafts make at least a portion of one revolution with said follower portion in contact with said first side cam surface and then at least a portion of a revoluation with said follower portion in contact with said second side cam portion, second carriage moving means for moving said carriage vertically from said operative position to said inoperative position comprising a raised first peripheral cam surface on the periphery of said first cam, a roller mounted on said base and engageable by said first peripheral cam surface to cause said carriage to move from said operative position to said inoperative position when engaged by said first peripheral surface, whereby when said first cam is rotated to the point where said first peripheral cam surface engages said roller, said carriage is moved to said inoperative position, third carriage moving means for moving said carriage from said operative position to said inoperative position comprising a rotatable second cam having a second peripheral cam surface, a lever pivotally mounted on said base and engageable with said second peripheral cam surface, second resilient means biasing said lever into engagement with said second peripheral cam surface, a rocker arm engageable by said lever, a pendulum pivotally attached at one end to said base and having a second feeler means attached to its free end, said second feeler means being engageable with the lower portion of said template, said pendulum being engageable by said rocker arm whereby operation of said lever by said second peripheral cam surface causes said rocker arm to move said pendulum and said second feeler means upwardly to engage said template and thereafter move said carriage upwardly to said inoperative position, and switch means for controlling said motor means for driving said halfshafts and said first and second cams, said switch means being mounted on said pendulum and being operated when said feeler means contacts said template to incrementally rotate said halfshafts and said cams.

2. The lens beveling machine of claim 1 wherein said second peripheral cam surface is so oriented with respect to said second side cam surface as to operate said third carriage moving means immediately prior to the arrival of said follower at said second side cam surface, whereby said lens is not in engagement with said wheels when said first carriage moving means moves said carriage laterally from said rough grinding position to said beveling position.

3. The lens beveling machine of claim 1 wherein said arm is pivotally mounted at one end on said carriage, said feeler is located at the other end thereof, and said follower is located intermediate said ends.

4. The lens beveling machine of claim 3 wherein said guide is inclined to a specific angle with respect to the path of vertical movement of said carriage to cause said carriage to move laterally a predetermined amount during each cycle of movement from said inoperative position to said operative position to cause the beveling wheel to be applied to the desired portion of the periphery of the lens.

5. The lens beveling machine of claim 1 wherein the position in elevation of the carriage is determined by the contact between the periphery of the wheels or by the template engaging the pendulum, when said peripheral cam surfaces are not in operation.

6. The lens beveling machine of claim 1 wherein said switch means comprises a longitudinally movable shaft carrying a movable contact engageable with a fixed contact.

* * * * *